US011572320B2

(12) United States Patent
Habibi et al.

(10) Patent No.: US 11,572,320 B2
(45) Date of Patent: Feb. 7, 2023

(54) HYPERGOLIC SYSTEM

(71) Applicant: NEWROCKET LTD., Beer Sheva (IL)

(72) Inventors: Avihay Habibi, Netivot (IL); Zohar Schlagman, Tel-Mond (IL); Moti Elyashiv, Netanya (IL)

(73) Assignee: NEWROCKET LTD., Beer Sheva (IL)

( * ) Notice: Subject to any disclaimer, the term of this patent is extended or adjusted under 35 U.S.C. 154(b) by 0 days.

(21) Appl. No.: 17/665,539

(22) Filed: Feb. 6, 2022

(65) Prior Publication Data

US 2022/0324774 A1 Oct. 13, 2022

Related U.S. Application Data

(63) Continuation of application No. 15/768,042, filed as application No. PCT/IL2016/051111 on Oct. 13, 2016, now Pat. No. 11,242,295.

(30) Foreign Application Priority Data

Oct. 13, 2015 (IL) ..... 242062

(51) Int. Cl.

| | |
|---|---|
| ***C06B 47/00*** | (2006.01) |
| ***C06B 45/30*** | (2006.01) |
| ***C06B 27/00*** | (2006.01) |
| ***C06B 47/02*** | (2006.01) |
| ***C06B 47/10*** | (2006.01) |
| *C06B 45/00* | (2006.01) |
| *C06B 45/18* | (2006.01) |
| *C06B 45/12* | (2006.01) |
| *C06B 45/14* | (2006.01) |
| *C06B 45/04* | (2006.01) |
| *D03D 23/00* | (2006.01) |
| *D03D 43/00* | (2006.01) |

(52) U.S. Cl.

CPC ..... *C06B 45/30* (2013.01); *C06B 27/00* (2013.01); *C06B 47/02* (2013.01); *C06B 47/10* (2013.01)

(58) Field of Classification Search

USPC ..... 149/1, 2, 3, 5, 14, 15, 17, 87, 108.2, 149/108.6, 109.4

See application file for complete search history.

(56) References Cited

U.S. PATENT DOCUMENTS

| | | | |
|---|---|---|---|
| 3,392,528 | A | 7/1968 | Moutet et al. |
| 3,921,394 | A | 11/1975 | Tannenbaum |
| 5,348,597 | A | 9/1994 | Wong |

(Continued)

FOREIGN PATENT DOCUMENTS

| | | | |
|---|---|---|---|
| WO | 2009102259 | A1 | 8/2009 |
| WO | 2011001435 | A1 | 11/2011 |

OTHER PUBLICATIONS

PCT International Search Report for International Application No. PCT/IL2016/051111, dated Jan. 10, 2017, 4pp.

(Continued)

*Primary Examiner* — James E McDonough

(74) *Attorney, Agent, or Firm* — The Roy Gross Law Firm, LLC; Roy Gross

(57) ABSTRACT

The present invention provides a particle and a composition for e.g., hypergolic ignition of rocket propellant. The disclosed particle and the composition comprise an energetic fuel additive and an ignition agent wherein the ignition agent is deposited on a surface of the particle.

7 Claims, 2 Drawing Sheets

(56) References Cited

U.S. PATENT DOCUMENTS

| | | | | |
|---|---|---|---|---|
| 5,451,277 | A | 9/1995 | Katzakian et al. | |
| 8,336,287 | B1 | 12/2012 | Petersen et al. | |
| 9,233,883 | B1 | 1/2016 | Rauscher et al. | |
| 2003/0192633 | A1* | 10/2003 | Diede | C06B 47/02 149/109.2 |
| 2004/0265214 | A1* | 12/2004 | Anderson | B01J 35/0013 423/579 |
| 2009/0000186 | A1 | 1/2009 | Sanders et al. | |
| 2014/0227548 | A1* | 8/2014 | Myrick | C10L 1/28 203/40 |
| 2015/0099182 | A1* | 4/2015 | Singh | H01M 4/134 429/231.6 |

OTHER PUBLICATIONS

PCT Written Opinion for International Application No. PCT/IL2016/051111, dated Jan. 10, 2017, 6pp.

* cited by examiner

HYPERGOLIC SYSTEM

RELATED APPLICATIONS

This application is a continuation of U.S. Ser. No. 15/768,042 filed Apr. 13, 2018, which is a National Phase of PCT Patent Application No. PCT/IL2016/051111 having International filing date of Oct. 13, 2016, which claims the benefit of priority from Israeli Patent Application No. 242062, filed on Oct. 13, 2015. The contents of the above applications are all incorporated by reference as if fully set forth herein in their entirety.

FIELD OF INVENTION

This invention is directed to, inter alia, to a particle comprising an energetic fuel additive and an ignition agent.

BACKGROUND OF THE INVENTION

Hypergolic propellants can be used in a wide range of applications due to their advantages, including: simplicity (i.e. eliminating the need for a separate ignition source and being reliable with reduced weight), and safety (i.e. preventing accumulation of unreacted propellant).

Fuels, such as monomethylhydrazine combined with oxidizers, including nitrogen tetroxide or inhibited red fuming nitric acid, have typically been employed in hypergolic bipropellant systems. However, these propellants are considered as highly toxic and carcinogenic chemicals to humans, making their implementation in propulsion systems expensive and problematic.

In the last decades, there is a growing interest in the use of hydrogen peroxide as an alternative oxidizer due to its properties such as non-toxic (green propellant), non-cryogenic, storable with a high density specific impulse. Several studies have been conducted to investigate the hypergolicity of hydrogen peroxide with different types of fuels.

In nature, hydrogen peroxide and kerosene do not ignite upon contact. By using a gelled fuel, a uniform suspension of reactive or catalytic particles that react exothermically with hydrogen peroxide can be achieved. The generated heat enables the fuel to reach its flash point which results in ignition, hence, renders the fuel hypergolic with hydrogen peroxide.

The commonest catalytic and reactive additives for the decomposition of hydrogen peroxide are complexes of transition metal salts composed of high atomic weight atoms (such as manganese, copper and iron) and metal hydrides, respectively.

The decomposition process of hydrogen peroxide occurs mainly on the surface area of the catalytic/reactive particles so that the inner volume does not contribute to the reaction or, in other words, the particles are not fully combust or combust in a lower rate. In a case of rocket engine, the propellant residence time in the combustion chamber must be sufficiently long for the propellant to heat up, vaporize and combust, otherwise, two-phase flow losses will occur.

The main physical reason for these losses is the absence of thermal and momentum equilibrium between the gaseous phase and the condensed phase e.g., during a supersonic expansion. The condensed phase particles move slower with respect to the surrounding gasses and exchange heat with the environment at a slower rate, causing the conversion of thermochemical enthalpy into kinetic energy of the flow to be less efficient. This eventually ends up in a reduction of the exhaust gas velocity and in a subsequent lower specific impulse. These losses can be optimized and reduced by using lowered amount of catalytic/reactive additives, however, for reducing the ignition delay time, namely, the time interval between the contact of the fuel and the oxidizer and their ignition moment, a large quantity of catalytic/reactive additives may be required.

Beside the addition of the catalyst/reactive particles, it is well known that combining energetic particles, such as aluminum, magnesium and boron in propellants improves the rocket performance because of their high energy density and/or high heat of combustion which increases the flame temperature and decreases the gaseous product molecular weight (i.e. CO and $H_2$ instead of $CO_2$ and $H_2O$, respectively), however, the two-phase flow loss is further derived from the propensity of the particles to aggregate, and to form agglomerates, sinter and coalesce prior to the ignition. Thus, the velocity of the surrounding gaseous products is slowed and they do not fully transfer their thermal energy to the flow. Other undesirable effect associated with agglomerates is that they have higher ignition temperature as well as longer burning time.

WO2011/001435 discloses a composition and a system for hypergolic ignition of rocket propellant. The composition includes the suspension of catalytic or reactive particles in a gelled fuel. The catalytic or reactive particles initiate a reaction upon contact with an oxidizer.

SUMMARY OF THE INVENTION

This invention is directed to, inter alia, to a particle comprising an energetic fuel additive and an ignition agent. The particles can ignite hypergolically (i.e. upon contact) with an oxidizer.

The reactivity of fuel and oxidizers are increased by the ignition layer coating the energetic fuel additive (e.g., metal particles). This coating layer produces a larger catalytic surface area to mass ratio, and therefore, may increase the probability of the reaction between the ignition layer and the oxidizer (e.g., hydrogen peroxide).

According to some embodiments of the present invention, there is provided a particle comprising an energetic fuel additive and an ignition agent wherein the ignition agent is deposited on at least one surface of the particle.

In some embodiments, a mass ratio of the ignition agent to the energetic fuel additive ranges from 0.01 to 2.

In some embodiments, the particle is in the form of a core shell structure, wherein the core comprises the energetic fuel additive and the shell comprises the ignition agent.

In some embodiments, the ignition agent comprises one or more materials selected from a metal hydride, a metal salt, and an alkyl-substituted amine. In some embodiments, the metal hydride is selected from sodium borohydride and lithium aluminum hydride. In some embodiments, the alkyl-substituted amine is selected from an alkyl-substituted diamine and an alkyl-substituted triamine In some embodiments, the energetic fuel additive comprises one or more materials selected from a metal oxide, a metal and a metalloid, and any combination thereof. In some embodiments, the material comprises a metal boride or boron carbide ($B_4C$). In some embodiments, the metal boride comprises is selected from $AlB_{12}$, $AlB_2$, $MgB_2Al_{0.5}Mg_{0.5}B_2$, $AlMgB_{14}CoB$, $CoB_2$, TiB and $TiB_2$.

In some embodiments, the metal is: zirconium (Zr), cobalt (Co), aluminum (Al), titanium (Ti), magnesium (Mg), iron (Fe), Zinc (Zn), tin (Sn), lithium (Li), nickel (Ni), beryllium (Be), or any combination thereof. In some embodiments, the metalloid comprises silicon (Si), boron (B) or a combination thereof.

In some embodiments, the metal oxide is selected from bismuth oxide, boron (III) oxide, chromium (III) oxide, manganese (IV) oxide, iron (III) oxide, copper (II) oxide, and lead (II,IV) oxide.

According to some embodiments of the present invention, there is provided a composition comprising the disclosed particle wherein the composition further comprises a fuel, wherein the particle is suspended in the fuel.

In some embodiments, the energetic fuel additive is at a concentration ranging from 0.1% to 15%, or from 0.1% to 10%, or from 1% to 10%, or from 3% to 5%, by total weight of the fuel, the energetic fuel additive, and the ignition agent.

In some embodiments, the composition further comprises an oxidizer. In some embodiments, the oxidizer comprises cerium, chlorite, bromite, fluorite, chlorate, bromate, fluorate, hyporchlorite, hydrogen peroxide, oxygen, nitrous oxide, nitrous acid, nitric acid, perchloric acid or any combination thereof. In some embodiments, the oxidizer comprises an aqueous solution comprising at least 1%, at least 5%, or at least 10%, hydrogen peroxide, by weight of the solution.

In some embodiments, the composition further comprises a fuel and optionally an oxidizer. In some embodiments the oxidizer is in the form of a liquid or a gel.

According to some embodiments of the present invention, there is provided a composition comprising a fuel, a particle comprising an energetic fuel additive and an ignition agent, and an oxidizer in the form of a liquid or a gel, wherein the particle is suspended in the fuel.

In some embodiments, the composition is a hypergolic propellant combination.

In some embodiments, the oxidizer is in the form of a gel. In some embodiments, the fuel, oxidizer or both further comprises a gelling agent. In some embodiments, the gelling agent is at a concentration ranging from 0.1% to 10%, by total weight of the fuel, the energetic fuel additive, the ignition agent, and the gelling agent. In some embodiments, the gelling agent comprises one or more materials selected from a nano-silica fumed powder, aluminum stearate, carbopol, methocel, and paraffin.

In some embodiments, the fuel comprises hydrocarbon or liquid hydrogen. In some embodiments, the hydrocarbon is kerosene. In some embodiments, the kerosene is at a concentration ranging from 60% to 96%, (wt. %).

In some embodiments, the ignition agent is at a concentration ranging from 0.1% to 20%, or 0.1% to 10%, or 2% to 5%, by total weight of the fuel, the energetic fuel additive, and the ignition agent.

According to some embodiments of the present invention, there is provided a method for obtaining a hypergolic composition, the method comprising the steps of obtaining a coated particle by coating at least one ignition agent on at least one surface of a solid particle comprising an energetic fuel additive; mixing a gelling agent and a liquid fuel, thereby obtaining a gelled fuel; and suspending the coated particle in the gelled fuel, thereby obtaining the hypergolic composition.

According to some embodiments of the present invention, there is provided a kit of parts comprising a first container comprising a fuel and the disclosed particle and a second container comprising an oxidizer.

In some embodiments, the kit of parts comprises a means for contacting a fuel and the disclosed particle from the first container with the oxidizer from the second container.

In some embodiments, the means comprises a tube and/or a suction channel In some embodiments, the tube is a combustion chamber. In some embodiments, the suction channel is pressurized system and/or injection system.

In some embodiments, the means is a third container.

In some embodiments, the kit of parts further comprises an instruction sheet, and/or a label.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION OF THE INVENTION

Figure 1:
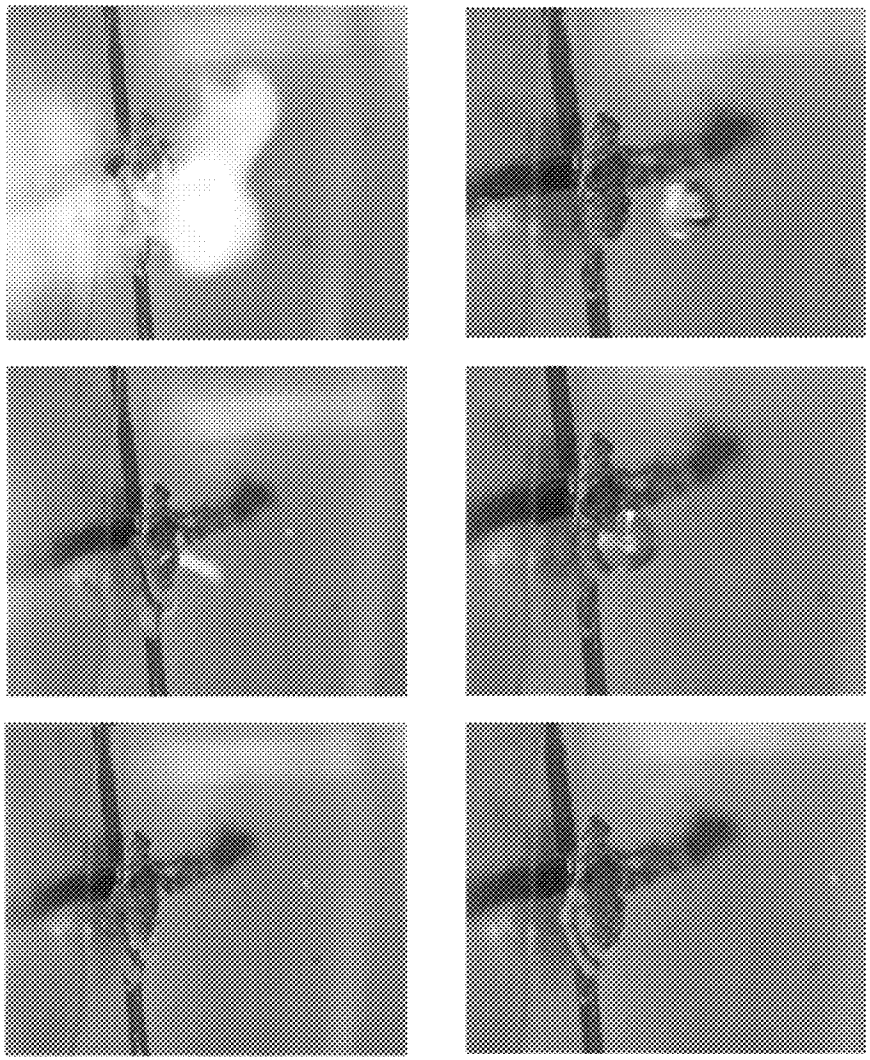
FIG. 1 presents sequential images (moving clockwise from the upper left panel) of typical 'drop on drop' test showing hypergolic ignition of 90% hydrogen peroxide with gelled fuel containing 5% (wt. %) of aluminum coated by 3% (wt. %) of $NaBH_4$.

The present invention, in some embodiments thereof, relates to a particle comprising an energetic fuel additive and an ignition agent.

The disclosed particle or composition, in an embodiment thereof, is a hypergolic particle or composition, respectively, e.g., igniting a fuel source. In another embodiment, a hypergolic particle or composition comprising the hypergolic particle is utilized for a propellant e.g., a rocket propellant.

Before explaining at least one embodiment of the invention in detail, it is to be understood that the invention is not necessarily limited in its application to the details set forth in the following description or exemplified by the Examples. The invention is capable of other embodiments or of being practiced or carried out in various ways.

According to an aspect of some embodiments of the present invention, there is provided a particle comprising an energetic fuel additive and an ignition agent. In some embodiments, the ignition agent is deposited on and/or coats at least one surface of the particle.

In some embodiments, the particle can ignite hypergolically (i.e. upon contact) with an oxidizer. The fuel and the oxidizer may be chosen from a wide spectrum of materials. In some embodiments, the fuel and/or the oxidizer are environmentally friendly (green propellants) without the need of carrying a protective equipment. These propellants may provide the necessary energy for propulsion.

As noted hereinabove, the reactivity of fuel and oxidizers may be increased by coating the energetic fuel additive (e.g., metal particles) with the ignition layer. In one embodiment, the physical proximity of an oxidizer and an energetic fuel additive within a single particle provides an unexpectedly efficient hypergolic composition. Without being bound by any particular theory and mechanism, this coating layer produces a larger catalytic surface area to mass ratio, therefore, increases the reaction efficiency between the ignition layer and the oxidizer (e.g., hydrogen peroxide).

Without wishing to be bound by any particular theory or mechanism, a further advantage is associated with the coating is that the local decomposition temperature (around 1000 K for 90% of hydrogen peroxide (HP)) increases the reaction and burning rate of the energetic fuel additives. As this exothermic reaction occurs at the surface of the particles, they ignite, produce more gaseous products and dispersed into smaller particles which burn quickly, thus, reducing the two phase flow losses.

As used herein, the terms "energetic fuel additive", "fuel additive" or, for simplicity, "additive", mean a substance that is added to fuel and/or employed to treat effluent derived from the combustion of fuel. For example, and without limitation, the fuel additive may comprise a polymer adapted to improve the combustion efficiency of a fuel-burning device. In some embodiments, the additive may improve the distribution of fuel into the engine. In some embodiments, the additive may improve an engine operating performance. In some embodiments, the additive may improve the stability of an engine operation in the time. In some embodiments, the additive may improve the rocket performance e.g., because of their high heat of combustion and/or high energy density.

As noted hereinabove, and without wishing to be bound by any particular theory or mechanism, the high combustion heat increases the flame temperature and decreases the gaseous product molecular weight (i.e. CO and $H_2$ instead of $CO_2$ and $H_2O$, respectively).

In some embodiments, the additive is a solid in the room temperature (e.g., about 25° C.).

In some embodiments, the additive is or comprises a metal. Non-limiting examples of metals are aluminum (Al), lithium (Li), nickel (Ni) magnesium (Mg), iron (Fe), cobalt (Co), titanium (Ti), zirconium (Zr), Zinc (Zn) and tin (Sn).

In some embodiments, the additive is or comprises a metal compound, for example and without being limited thereto, an organometallic or a Grignard compound of the metals such as lithium, sodium, lead, beryllium, magnesium, aluminum, gallium, zinc, cadmium, tellurium selenium, silicon, or a metalloid e.g., boron, germanium, antimony and/or tin. In some embodiments, the additive is or comprises a metalloid oxide, e.g., boron (III) oxide.

In some embodiments, the additive is or comprises a metal complex, for example, and without limitation, the metal complex of scandium, titanium, vanadium, chromium, manganese, iron, cobalt, nickel, copper, zinc, ruthenium, rhodium, palladium, osmium, indium, platinum, silver, gold, gallium, molybdenum, lead and mercury, e.g., with different ligands, or as a mixture.

In some embodiments, the additive is or comprises a metal oxide. Exemplary metal oxides are selected from, but are not limited to, bismuth oxide, chromium (III) oxide, manganese (IV) oxide, iron (III) oxide, copper (II) oxide and lead (II,IV) oxide.

In some embodiments, the additive is or comprises a metal boride. Exemplary metal borides are selected from, but are not limited to, $AlB_{12}$, $AlB_2$, $MgB_2$ $Al_{0.5}Mg_{0.5}B_2$, $MgAlB_{14}$, CoB, $CoB_2$, titanium boride (TiB) and titanium diboride ($TiB_2$).

In some embodiments, the additive is or comprises a metalloid. As used herein and in the art the term "metalloid" refers to a chemical element having both metals and non-metals properties. In some embodiments the metalloid is selected from boron, silicon, germanium, arsenic, antimony, and tellurium.

In some embodiments, "metalloid" may refer to carbon, aluminum, selenium, polonium, and astatine.

In some embodiments, the additive is or comprises a metalloid selected from silicon (Si), and boron (B).

In some embodiments, the additive is or comprises a metalloid composition. Exemplary metalloid composition may be boron carbide ($B_4C$).

As used herein, by "deposited on at least one surface" it is also meant to refer to at least portion of at least one surface that is coated or being deposited thereon.

By "portion" it is meant to refer to, for example, a surface or a fragment thereof. In some embodiments, by "a portion", it is meant e.g., at least 1 percent, at least 10 percent, at least 20 percent, at least 30 percent, at least 40 percent, at least 50 percent, at least 60 percent, at least 70 percent, at least 80 percent, at least 90 percent, or optionally all of the surface is coated, as feasible.

In some embodiments, the ignition agent is in amount such that the mass ratio of the ignition agent to the energetic fuel additive ranges from e.g., 0.01 to 2, 0.05 to 2, or 0.50 to 0.98. In some embodiments, the mass ratio ranges from 0.60 to 0.98, from 0.65 to 0.98, from 0.70 to 0.98, from 0.80 to 0.98, from 0.85 to 0.98, from 0.90 to 0.98, or from 0.90 to 0.98. In some embodiments, the mass ratio ranges from 0.60 to 0.95, from 0.60 to 0.90, from 0.60 to 0.85, from 0.60 to 0.80, from 0.60 to 0.75, or from 0.60 to 0.70. In some embodiments, the ignition agent is in amount such that the mass ratio of the energetic fuel additive to the ignition agent is e.g., 0.50, 0.55, 0.60, 0.65, 0.70, 0.75, 0.80, 0.85, 0.90, 0.95, 0.98, or 0.99, including any value therebetween.

In some embodiments, the disclosed particle is in the form of heterostructure. The term "heterostructure" as used herein means a structure in which materials having different compositions meet at interfaces.

A non-limiting example of heterostructure is the form of a core-shell structure. The term "core-shell structure" generally refers to a solid material, wherein the solid material is a particulate material, and wherein individual particle(s) is characterized by containing at least two different types of materials which may be distinguished from one another by their composition and/or by their structure and/or by their placement within the particle, wherein one or more materials of a certain type are contained in the interior portion of the particles. The interior portion is designated by the term "core", and one or more materials of a certain type which may be distinguished from the one or more materials contained in the interior portion are contained in the outer portion of the particles, thus forming the surface portion thereof and/or hydrogen peroxide, oxygen, nitrous oxide, nitrous acid, nitric acid, perchloric acid or any combination thereof. The outer portion comprising the surface is designated by the terms "shell" or "coating layer".

In some embodiments, the core-shell structure is a closed structure.

The term "closed" as used herein is a relative term with respect to the size, the shape and the particle or composition of two entities, namely an entity that defines an enclosure (the enclosing entity) and the entity that is being at least partially enclosed therein. In general, the term "closed" refers to a morphological state of an object which has discrete inner (e.g., the core) and outer surfaces which are substantially disconnected, wherein the inner surface constitutes the boundary of the enclosed area. The enclosed area may be at least partially secluded from the exterior area of space.

In some embodiments, the additive defines the core. In some embodiments, the ignition agent defines the shell.

In some embodiments, the shell (or the coating layer) has a thickness of e.g., 2 nm, 10 nm, 20 nm, 30 nm, 30 nm, 40 nm, 50 nm, 60 nm, 70 nm, 80 nm, 90 nm, 100 nm, 120 nm, 140 nm, 160 nm, 180 nm, 200 nm, 250 nm, or 300 nm, including any value therebetween.

In some embodiments, the shell (or the coating layer) has a thickness that ranges from e.g., 1 to 200 nm, 5 to 200 nm, 10 to 200 nm, or 20 to 200 nm, 1 nm to 100 nm, or 5 nm to 50 nm.

In some embodiments the particle is nanosized.

As provided herein, the terms "nanoparticle","nanostructure", "nano", "nanosized", and any grammatical derivative thereof, which are used herein interchangeably, describe a particle featuring a size of at least one dimension thereof (e.g., diameter, length) that ranges from about 1 nanometer to 1000 nanometers.

In some embodiments, the size of the particle described herein represents an average size of a plurality of nanoparticle composites or nanoparticles.

In some embodiments, the average size (e.g., diameter, length) ranges from about 50 nanometer to about 1000 nanometers. In some embodiments, the average size ranges from about 50 nanometer to about 500 nanometers. In some embodiments, the average size ranges from about 50 nanometer to about 300 nanometers. In some embodiments, the average size ranges from about 50 nanometer to about 200 nanometers. In some embodiments, the average size ranges from about 50 nanometer to about 100 nanometers.

In some embodiments the particle is microsized.

As provided herein, the terms "microparticle,"microstructure", "micro", "microsized", and any grammatical derivative thereof, which may be used interchangeably, describe a particle featuring a size of at least one dimension thereof (e.g., diameter, length) that ranges from about 1 micrometers to 10 micrometers.

In some embodiments, the average size is about 1 μm, about 2 μm, about 3 μm, about 4 μm, about 5 μm, about 6 μm, about 7 μm, about 8 μm, about 9 μm, or about 10 μm, including any value therebetween.

In some embodiments, the average size ranges from about 1 micrometer to 10 micrometers. In some embodiments, the average size ranges from about 1 micrometer to 5 micrometers. In some embodiments, the average size ranges from about 5 micrometer to 10 micrometers.

In some embodiments, there is provided composition comprising the disclosed particle in some embodiment thereof. In some embodiments, the composition further comprises a fuel. In some embodiments, the composition further comprises an oxidizer. In some embodiments, the oxidizer is in the form of a liquid or a gel. In some embodiments, the particle is suspended in the fuel. In some embodiments, the composition is a hypergolic propellant combination. A hypergolic propellant combination is one where the propellants spontaneously ignite when they come into contact with each other and may be used e.g., in a rocket engine.

The Composition

In some embodiments, there is provided composition comprising a fuel, a particle comprising an energetic fuel additive and an ignition agent. In some embodiments, the composition further comprises an oxidizer. In some embodiments, the particle is suspended in the fuel. In some embodiments, the particle is suspended in the oxidizer (e.g., prior to reaction thereof).

In some embodiments, the ignition agent (e.g., sodium borohydride) is less than 5% (wt. %). In some embodiments, the ignition agent (e.g., sodium borohydride) is less than 3% (wt. %).

Unless stated otherwise by "wt. %" or "% wt." it is meant to refer to relative to the total weight of the composition (excluding the oxidizer if exists).

In some embodiments, the oxidizer is in the form of a liquid. In some embodiments, the oxidizer is in the form of a gel. In some embodiments, fuel is in the form of a liquid. In some embodiments, the fuel is in the form of a gel.

The term "gel" used herein refers to a semisolid colloidal suspension of a solid in a liquid. Thus, a gel comprises a continuous liquid phase and a dispersed phase (e.g., a liquid or solid phase). Exemplary gels include a solid phase dispersed in a liquid phase.

In some embodiments, the gel is a shear thinning fluid. As used herein, the term "shear thinning" refers to a property of a fluid, wherein the gel viscosity decreased under increasing shear stress, or even liquefies.

In some embodiments, the gel is a thixotropic fluid. As used herein, the terms "thixotropic" and "thixotropy" describe a property of a fluid, whereby the gel viscosity is reduced under constant shear stress, even liquifies when disturbed (e.g., agitated, for example, by stirring, by downstream flow), and returns to a semisolid, gel state after the disturbance ceases.

In some embodiments, the composition comprises a gelling agent. In some embodiments, the oxidizer comprises a gelling agent. In some embodiments, the fuel comprises a gelling agent.

As used herein, the phrase "gelling agent" describes a compound which may be added to a liquid, wherein upon its addition to the liquid, the resulting composition becomes a gel.

The gelling agent may comprise e.g., an organic composition. The gelling agent may comprise a polymeric material.

Non-limiting examples of gelling agents are nano-silica fumed powder, aluminum stearate, cross-linked polymer (e.g., carbopol), methyl cellulose (e.g., methocel), paraffin and any combination thereof.

In exemplary embodiments, the gelling agent is nano-silica fumed powder.

In some embodiments, the mass ratio of gelling agent to fuel (e.g., nano-silica fumed powder) is 0.01, 0.015, 0.020, 0.025, 0.030, 0.040, 0.045, 0.050, 0.060 or 0.070, including any value or range therebetween.

In exemplary embodiments, the mass ratio of nano-silica to fuel to fumed is 0.032.

In some embodiments, the size of the particle described herein represents an average size of a plurality of nanoparticles of the nano-silica fumed powder or an aggregate thereof.

In some embodiments, the average size (e.g., diameter, length) of the aggregate ranges from about 1 nanometer to 500 nanometers. In some embodiments, the average size ranges from about 100 nanometer to about 400 nanometers.

In some embodiments, the average size ranges from about 200 nanometer to about 300 nanometers.

In some embodiments, the average size is about 50 nm, about 60 nm, about 70nm, about 80 nm, about 90 nm, about 100 nm, about 110 nm, about 120 nm, about 130 nm, about 140 nm, about 150 nm, about 160 nm, about 170 nm, about 180 nm, about 190 nm, about 200 nm, about 210 nm, about 220 nm, about 230 nm, about 240 nm, about 250 nm, about 260 nm, about 270 nm, about 280 nm, about 290 nm, about 300 nm, about 310 nm, about 320 nm, about 330 nm, about 340 nm, about 350 nm, about 360 nm, about 370 nm, about 380 nm, about 390 nm, or about 400 nm, including any value and range therebetween.

The gelling agent may optionally further comprise one or more materials which may be added thereto, for example, to improve the texture of the gel and/or its physical properties, and/or to preserve its contents. These materials may also be added so as to prevent precipitation of the inorganic salt, which leads to decomposition of the gel consistency of the composition. Such materials that are suitable for use in the context of the present embodiments include, without limitation, celite, bentonite, silica (e.g., fumed silica) and povidone (a.k.a. PVD, polypyrrolidone), which may be used to increase the viscosity of the gel. The appropriate concentration may be determined by one of skill in the art through routine experimentation.

In some embodiments, the gel is characterized by a viscosity at the room temperature (e.g., about 25° C.).

In some embodiments, the fuel may initially be in gelatin-like state or may be gelled using the selected gelling agent with the ignition agent held in a suspension.

It will be appreciated that the operational conditions for rocket propellant often involve extremely high acceleration forces. The mechanical properties of the gelatinous mixture are preferably such that no sedimentation or coagulation occurs even under such conditions.

Accordingly, in some embodiments, the gelled fuel has a viscosity large enough to prevent sedimentation and/or coagulation of the energetic fuel additive (e.g., additive coated by the ignition agent) in a condition of e.g., high acceleration.

The viscosity may have a value ranging from 0.001 Pa·s to 1000 Pa·s.

In some embodiments, the viscosity has a value that ranges from e.g., 0.001 Pa·s to 1 Pa·s, 0.001 Pa·s to 10 Pa·s, 0.001 Pa·s to 100 Pa·s, 0.001 Pa·s to 1000 Pa·s. In some embodiments, the viscosity has a value that ranges from e.g., 1 Pa·s to 10 Pa·s, 10 Pa·s to 100 Pa·s, or 100 Pa·s to 1000 Pa·s.

Viscosity can be measured by any method known in the art, e.g., using a rotating spindle viscometer.

Additionally or alternatively the viscosity is determined by rheological properties e.g., the yield point, also known in the art as yield stress.

In some embodiments, the gelling agent is at a concentration ranging from 0.1% to 10%, by weight of the by total weight of the fuel, the gelling agent, the energetic fuel additive, and the ignition agent. In some embodiments, the gelling agent is at a concentration ranging from 0.1% to 1%, by weight of the fuel, the gelling agent, the energetic fuel additive, and the ignition agent. In some embodiments, the gelling agent is at a concentration ranging from 0.1% to 5%, by weight of the fuel, the gelling agent, the energetic fuel additive, and the ignition agent. In some embodiments, the gelling agent is at a concentration ranging from 1% to 5%, by weight of the fuel, the gelling agent, the energetic fuel additive, and the ignition agent. In some embodiments, the gelling agent is at a concentration ranging from 5% to 10%, by weight of the fuel, the gelling agent, the energetic fuel additive, and the ignition agent.

As used herein and in the art, the term "oxidizer" refers to any suitable source of oxygen e.g., for the combustions reaction. Examples of suitable oxidizers include, but are not limited to, nitrous oxide, nitrous acid, nitric acid, oxygen, air, calcium nitrate, ammonium nitrate, and any other suitable oxygen containing compound.

In some embodiments, the oxidizer is or comprises cerium, chlorite, bromite, fluorite, chlorate, bromate, fluorate, hyporchlorite, or any combination or solution thereof.

In some embodiments, the oxidizer is or comprises hydrogen peroxide.

In some embodiments, the hydrogen peroxide is an aqueous solution of at least e.g., 10%, 15%, 20%, 25%, 30%, 35%, 40%, 45%, 50%, 55%, 60%, 65%, 70%, 75%, 80%, 85%, 90%, 92%, 95%, or 98%, by total weight of the solution. In exemplary embodiments, the oxidizer is hydrogen peroxide 90%. In additional exemplary embodiments, the oxidizer is hydrogen peroxide 98%.

The term "fuel" as used herein, refers to any material that can be used to generate energy e.g., to produce mechanical work in a controlled manner.

In some embodiments, the fuel comprises one or more hydrocarbons (e.g., various fractions of petroleum). In some embodiments, the fuel comprises liquid hydrogen. In some embodiments, the fuel comprises a material selected from, but not limited to, alcohol (e.g., ethanol, isopropanol), amines (e.g., ethylene diamine, diethylene triamine, methylamine, cyclotetramethylenetetranitramine), amides (e.g., dicyanamide), metal-organic liquid compounds, alkaloids (e.g., imidazolium).

Non-limiting example of hydrocarbon is kerosene.

The term "kerosene" as used herein refers to the lighter fraction of crude petroleum that boils approximately in the range of 145° C. to 300° C. and is composed mainly of $C_8$-$C_{16}$ hydrocarbons. Included by this term are aviation turbine or rocket fuels for civilian (known as "Jet A" or "Jet A-I") and military (known as "JP-8", JP-4" or "JP-5") aircrafts, and military turbine fuel grades such as JP-4, JP-5, JP-8 and RP/1.

In some embodiments, the kerosene is at a concentration ranging from 1% to 98%, by weight of the fuel. In some embodiments, the kerosene is at a concentration ranging from 1% to 90%, by weight of the fuel. In some embodiments, the kerosene is at a concentration ranging from 10% to 98%, by weight of the fuel. In some embodiments, the kerosene is at a concentration ranging from 20% to 98%, by weight of the fuel. In some embodiments, the kerosene is at a concentration ranging from 30% to 98%, by weight of the fuel. In some embodiments, the kerosene is at a concentration ranging from 40% to 98%, by weight of the fuel. In some embodiments, the kerosene is at a concentration ranging from 50% to 98%, by weight of the fuel. In some embodiments, the kerosene is at a concentration ranging from 60% to 98%, by weight of the fuel. In some embodiments, the kerosene is at a concentration ranging from 70% to 98%, by weight of the fuel. In some embodiments, the kerosene is at a concentration ranging from 80% to 98%, by weight of the fuel. In some embodiments, the kerosene is at a concentration ranging from 90% to 98%, by weight of the fuel.

In some embodiments, the kerosene is at a concentration of 0.1%, 1%, 5%, 10%, 15%, 20%, 25%, 30%, 35%, 40%, 45%, 50%, 55%, 60%, 65%, 70%, 75%, 80%, 85%, 90%, 95%, 99%, or even 100% by weight of the fuel, including any value there between.

In exemplary embodiments, the fuel is at a concentration of 89% (wt. %).

In some embodiments, the ignition agent comprises one or more materials selected from a transition metal or a composition thereof, an alkali metal, a metal hydride, a metal salt, and an alkyl-substituted amine In some embodiments, the transition metals are selected from manganese (Mn), cobalt (Co), magnesium (Mg), vanadium (V), silver (Ag) chromium (Cr) platinum (Pt), ruthenium (Ru), palladium (Pd), iron (Fe), nickel (Ni) and copper (Cu).

A non-limiting exemplary composition of transition metal is $MnO_2$. In some embodiments, the metal hydrides are selected from, but not limited to, sodium hydride, sodium borohydride, aluminum hydride, lithium aluminum hydride, lithium borohydride, potassium borohydride, copper hydride, beryllium hydride, magnesium hydride, and any combination thereof.

In some embodiments, the ignition agent is selected so as to provide a hypergolic reaction with the oxidizer. Alternatively, the ignition agent is a catalyst which induces the reaction between the fuel and the oxidizer.

In some embodiments, each of the ignition agent and the additive comprises a different material.

By "different material" it is meant to refer to materials that differ in at least one chemical element. Alternatively or additionally, the term may be understood to encompass one or more materials having substantially different densities from each other, as well as one or more materials having two distinct fractions of solid particles, wherein the particles in each of the fractions being substantially different from those of the other.

In some embodiments, the ignition agent comprises a complex of an alkyl-substituted amine and a metal salt. In some embodiments, the alkyl-substituted amine is selected from the group consisting of an alkyl-substituted diamine and an alkyl-substituted triamine and the metal salt is the metal salt of an aliphatic carboxylic acid.

In some embodiments, the aliphatic carboxylic acid is selected from the group consisting of an acetate, a propionate and a butyrate.

In some embodiments, the ignition agent reacts upon contact with an oxidizer to produce an energetic reaction.

In some embodiments, the metal hydride is selected from the group consisting of sodium borohydride, lithium borohydride, lithium aluminum hydride, and potassium borohydride. Alternatively or additionally, the ignition agent comprises a hypergolic catalyst.

In some embodiments, the energetic fuel additive is at a concentration ranging from 0.1% to 40% by total weight of the fuel, the energetic fuel additive, and the ignition agent. In some embodiments, the energetic fuel additive is at a concentration ranging from 0.1% to 20% by total weight of the fuel, the energetic fuel additive, and the ignition agent. In some embodiments, the energetic fuel additive is at a concentration ranging from 0.1% to 10% by total weight of the fuel, the energetic fuel additive, and the ignition agent. In some embodiments, the energetic fuel additive is at a concentration ranging from 0.1% to 5% by total weight of the fuel, the energetic fuel additive, and the ignition agent. In some embodiments, the energetic fuel additive is at a concentration ranging from 5% to 10% by total weight of the fuel, the energetic fuel additive, and the ignition agent.

In some embodiments, the energetic fuel additive is at a concentration of e.g., 0.1%, 0.5%, 1%, 2%, 3%, 4%, 5%, 6%, 7%, %, 9%, 10%, 11%, 12%, 13%, 14%, 15%, 16%, 17%, 18%, 19%, or 20%, (by total weight of the fuel, the energetic fuel additive, and the ignition agent), including any value therebetween.

In exemplary embodiments, the energetic fuel additive is aluminum powder at a concentration of 5% (by total weight of the fuel, the energetic fuel additive, and the ignition agent).

In some embodiments, the instant fuels ignite generally within about 5 to 15 milliseconds (the ignition delay time). In some embodiments, the disclosed composition allows to reduce the ignition delay time to less than 15 milliseconds (ms). In some embodiments, the disclosed composition is characterized by ignition delay time of less than 10 ms. In some embodiments, the disclosed composition is characterized by a burning rate of at least 10% higher or, in some embodiments, at least 15% higher, compared to a reference composition comprising the same material content not having the form of coated additive.

Herein, the ignition delay is determined as the time interval between contact of the oxidizer (e.g., hydrogen peroxide) and fuel and the presence of flame.

In some embodiments, there is provided a method for obtaining a composition, the method comprising the steps of:

obtaining a coated particle by coating at least one ignition agent on at least one surface of a solid particle comprising an energetic fuel additive.

In some embodiments, the method further comprising the steps of:

mixing a gelling agent and a liquid fuel, thereby obtaining a gelled fuel; and suspending the coated particle in the gelled fuel, thereby obtaining the disclosed composition.

The term "obtaining", as used herein, refers interchangeably to providing, producing, and forming, and may include a step of mixing, adding, slurrying, stirring, heating, or a combination thereof.

In some embodiments, there is provided a kit of parts comprising a first container comprising the fuel and the particle and a second container comprising an oxidizer. In some embodiments, a first container and a second container are sealed containers. In some embodiments, the first container and a second container are separated from each other. In some embodiments, the composition within first container and the composition within the second container are mixed only upon use of the propellant. In some embodiments, the composition within first container and the composition within the second container are mixed within a third container or compartment. In some embodiments, the composition within first container and the composition within the second container are mixed only prior to combustion. In some embodiments, the composition within first container and the composition within the second container are mixed to initiate combustion.

In some embodiments, the kit of parts is for preparing a composition comprising: a fuel, a particle comprising an energetic fuel additive and an ignition agent and optionally an oxidizer in the form of a liquid or a gel.

As used herein, the term "kit-of-parts" is meant to encompass, inter alia, an entity of physically separated components, which are intended for individual use, but in functional relation to each other.

The container may be used to add liquid to the matrix material prior to use.

In some embodiments, the kit of parts further comprises a means for contacting the fuel and the particle from the first container with the oxidizer from the second container.

As used herein, the term "contacting" refers to the act of touching, making contact, or of bringing substances into immediate proximity In some embodiments, the means comprises one or more tubes. In some embodiments, the means comprises a third container.

In some embodiments, the tube is a combustion chamber. In some embodiments, the suction channel is pressurized system and/or injection system.

In some embodiments, the means is a third container.

In some embodiments, the kit of parts further comprises an instruction sheet, and/or a label.

In some embodiments, the means further comprises a suction channel. In some embodiments, the suction channel is a pressurized system and/or an injection system.

In some embodiments, the kit-of-parts further comprises an instruction sheet. In some embodiments, the kit-of-parts further comprises a label.

General

As used herein the term "about" refers to ±10%.

The terms "comprises", "comprising", "includes", "including", "having" and their conjugates mean "including but not limited to". The term "consisting of means "including and limited to". The term "consisting essentially of" means that the composition, method or structure may include additional ingredients, steps and/or parts, but only if the additional ingredients, steps and/or parts do not materially alter the basic and novel characteristics of the claimed composition, method or structure.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

As used herein the term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts.

As used herein, the term "treating" includes abrogating, substantially inhibiting, slowing or reversing the progression of a condition, substantially ameliorating clinical or aesthetical symptoms of a condition or substantially preventing the appearance of clinical or aesthetical symptoms of a condition.

In those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

EXAMPLES

Before giving an examples of embodiments of the invention, it is important to clarify that the invention is not limited to the following set of details exemplified by the embodiments.

Reference is now made to the following examples which, together with the above descriptions disclosed herewith, illustrate the invention in a non-limiting fashion.

Example 1

The Coating Process

In exemplary procedures, the coating process was performed by using $MnO_2$ as a catalyst, and included the following steps:

5 g of manganese nitrate $Mn(NO_3)_2 \cdot 4H_2O$ were dissolved in about 8 ml of preheated methanol (40° C.).

Next, 20 g of aluminum powder were added to the concentrated solution for impregnating, followed by drying until the whole liquid methanol was evaporated and drying again (60° C. for 2 h).

After drying, the coated particles were washed by water for removing impurities.

Example 2

Additional Coating Process

In additional exemplary procedures, coating of aluminum particle with sodium borohydride included the following steps:

Adding sodium borohydride to a non-aqueous solvent (dimethyl ether anhydrous) at ambient or slightly elevated temperature and stirring it using magnetic bar until the sodium borohydride was visibly dissolved;

adding aluminum powder to the solution, and all materials were constantly stirred until evaporation of the solvent, for achieving deposition of sodium borohydride on the surface of the aluminum, and keeping the coated aluminum in vacuum furnace at temperature of 50° C. for 1 hour (higher or lower temperature as well as shorter or longer duration may be used).

Example 3

Characterization of the Coated Particles

In order to verify the effectiveness of the disclosed coated particles, two types of experiments were carried out. The first type referred to as a 'drop on drop' test was intended for examining the influence of the disclosed particles on the ignition delay time, and the second type of experiments is a measurements of the burning rate of a gelled fuel with a total mass of 1-2 g. In all experiments, the hypergolic composition comprised the following reactants:

Jet-A1 fuel;

Fumed silica ($SiO_2$) particle with average aggregate size of 200-300 nm;

Sodium borohydride ($NaBH_4$) particles sized up to 40 μm;

Aluminum powder sized 6 μm, and

Hydrogen peroxide solution ($H_2O_2$) 90%.

In the manufacturing process of the gelled fuel, a premeasured amount of silica and jet-A1 fuel (with a fixed silica to fuel mass ratio of 0.032) were mixed until achieving homogeneity of the gel mixture. Once completely mixed, the aluminum and sodium borohydride (or coated aluminum particles—prepared by the process described in Example 2 above) were weighed and added to the gelled fuel in a nitrogen-filled glove box to minimize exposure to moisture.

For the drop on drop tests, a suitable setup was designed to enable accurate measurements of the ignition delay time. The setup comprised a pipette that was mounted to the laboratory stand at the height of 15 cm above a glass container. In all drop on drop tests, the gelled fuel was placed in the glass container and one drop of 90% hydrogen peroxide was dropped from the pipette into the container so that it centrally fell on the gelled fuel droplet. The ignition event was captured by high speed camera that was set to a framing rate of 1000 fps namely, the time interval between sequent frames was 1 ms. An example of such experiment can be seen in FIG. 1 which demonstrates a sequence of selected frames (with time interval between adjacent frames of 3 ms) taken from 'drop on drop' test movie made for gelled fuel containing 5% aluminum (wt. %) coated by 3% $NaBH_4$ (wt. %). The obtained ignition delay for this test was 9 ms.

Figure 2:
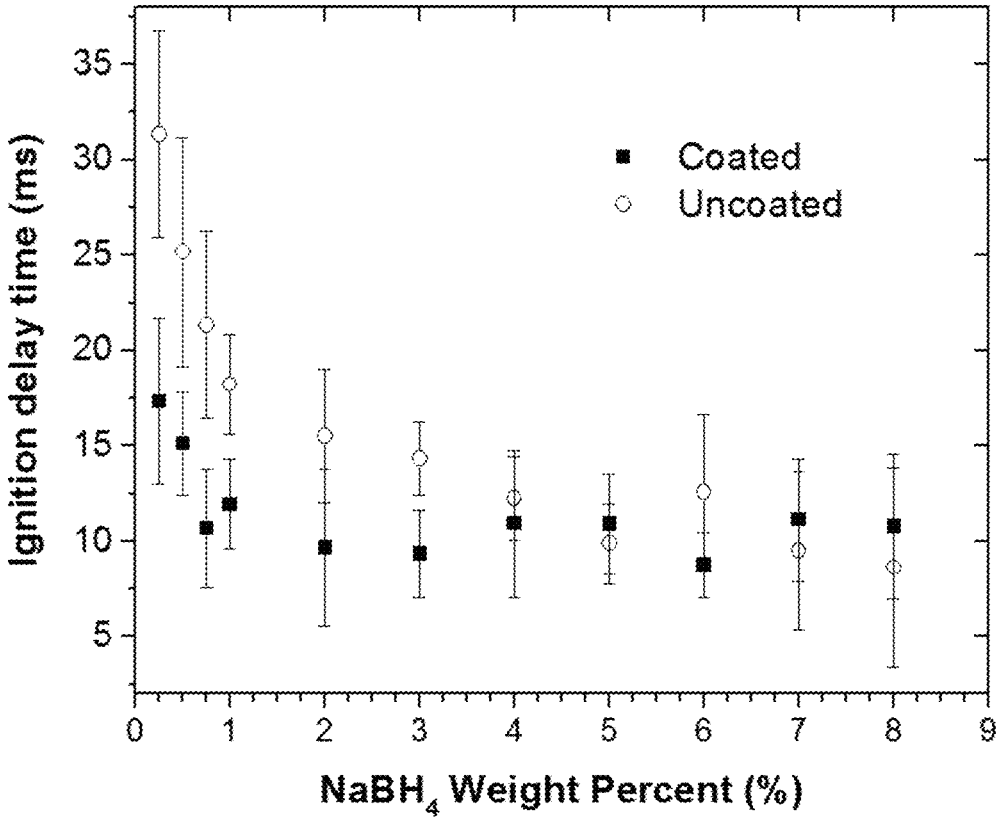
FIG. 2 presents graphs demonstrating ignition delay times measured for gelled fuel mixture containing 5% (wt. %) aluminum, coated or uncoated, with various percent of $NaBH_4$ (wt. %).

The data presented FIG. 2 depicts a comparison of an average ignition delay times with error bars given as one standard deviation measured for all experiments (at least 5) that were conducted for a given wt. % of sodium borohydride in the form of separated particles and coating layer on aluminum particles suspended in a gelled fuel. The sodium borohydride content ranges from 0.25% to 8% (wt. %) and the aluminum content was fixed at 5% (wt. %).

The results indicate that the usefulness of this invention, in terms of ignition delay times, is manifested in the lower concentration range of $NaBH_4$ (wt. % below 3) while for the higher $NaBH_4$ wt. % there is no clear influence. This fact can be explained through surface area perspective. For the lower of % $NaBH_4$ (wt. %), the coating process increases more significantly their surface area with respect to the original surface area, hence, the difference in ignition delay times obtained by the coated particle are manifested in the lower range of $NaBH_4$ weight percent. It may be assumed that if larger $NaBH_4$ particles diameter would be used, the benefit of this invention would span over wider range of $NaBH_4$ concentration.

Shortened values of ignition delay times can be obtained through two approaches. Firstly, by reducing the diameter of the coated aluminum/boron particles to such as submicron scale, since the $NaBH_4$ surface area to mass ratio increased, and secondly, by using highly concentrated solution of hydrogen peroxide (above 98%).

A similar test was done for a composition containing 5% (wt. %) of boron powder sized 6 μm (instead of aluminum) and 1% (wt. %) of $NaBH_4$ in two forms, coated and uncoated. The obtained average ignition delay times were 12.33 ms and 18.5 ms for the coated and uncoated forms, respectively.

Table 1 below summarizes the theoretical properties based on thermochemical calculations using Chemical Equilibrium with Applications (CEA) program (NASA) for gelled Jet A1—Sodium borohydride with 90% and 98% hydrogen peroxide and with a comparison to the currently used highly toxic hypergolic composition monomethyl hydrazine (MMH)/dinitrogen tetroxide (NTO).

TABLE 1

| | composition | | |
|---|---|---|---|
| Parameter | 90% **$H_2O_2$/Jet-A1 (89%) + Al (5%) $SiO_2$ (3%) + $NaBH_4$ (3%) | 98% **$H_2O_2$/Jet-A1 (89%) + Al (5%) $SiO_2$ (3%) + $NaBH_4$ (3%) | MMH/NTO |
| $I_{sp}$ (sec), Pe = 101 kPa | 265 | 271 | 289 |
| Density $I_{sp}$ (g · sec/cm$^3$), Pe = 101 kPa | 341 | 357 | 347 |

TABLE 1-continued

| Parameter | composition | | |
|---|---|---|---|
| | 90% **$H_2O_2$/Jet-A1 (89%) + Al (5%) $SiO_2$ (3%) + $NaBH_4$ (3%) | 98% **$H_2O_2$/Jet-A1 (89%) + Al (5%) $SiO_2$ (3%) + $NaBH_4$ (3%) | MMH/NTO |
| Vac $I_{sp}$ (sec), ε = 40 | 314 | 324 | 338 |
| Flame temperature (K) | 2765 | 2883 | 3300 |
| Ignition delay (ms) | 9 | n/a | 2-3 |

*percent in brackets refers to wt. %;
Pe denotes pressure at the nozzle exit;
$I_{sp}$ denotes specific impulse;
Vac denotes vacuum;
ε denotes nozzle expansion ratio (or nozzle area ratio);
**percent refers to concentration (by weight) in water.

For testing the influence of the composition on the burning rate, a comparison was made for identical gelled fuels containing 5% (wt. %) of aluminum and 0.25% (wt. %) of $NaBH_4$ in two forms: a separated aluminum and $NaBH_4$ particles, and in a form of coated aluminum by $NaBH_4$ layer. A gelled fuel with a total mass ranging from 1 to 2 gram, weighed by analytical balance with a precision of mg, was held in a test tube and based on maximum theoretical specific impulse calculation, a defined amount of 90% hydrogen peroxide was injected into the test tube. The reaction process (from ignition until the whole reactants were consumed) was filmed using high speed camera with a frame rate of 1000 frames per second (fps). After testing dozens of samples with different weights it was found that the burning time was 12% lower in average for the samples with a coated aluminum. It is assumed, without being bound by any particular theory, that since the surface area of $NaBH_4$ is higher in the coated form the achievable reaction rate is faster.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

The invention claimed is:

1. A particle comprising an energetic fuel additive and an ignition agent, wherein said ignition agent is deposited on at least one surface of said particle, wherein said ignition agent comprises a metal hydride, wherein said energetic fuel additive comprises one or more materials selected from the group consisting of: a metal oxide, a metal, a metalloid, and any combination thereof, wherein the ignition agent is in an amount such that the mass ratio of the ignition agent to the energetic fuel additive ranges from 0.01 to 2, wherein said particle is in the form of a core-shell structure, wherein said core comprises said energetic fuel additive and said shell comprises said ignition agent, wherein said particle is hypergolic.

2. The particle of claim 1, wherein said metal hydride is selected from the group consisting of: sodium borohydride, lithium aluminum hydride, and a combination thereof.

3. The particle of claim 1, wherein said metal is selected from the group consisting of: zirconium (Zr), cobalt (Co), aluminum (Al), titanium (Ti), magnesium (Mg), iron (Fe), Zinc (Zn), tin (Sn), lithium (Li), nickel (Ni), beryllium (Be), manganese (Mn), and any combination thereof.

4. The particle of claim 1, wherein said fuel additive comprises a metal boride or boron carbide ($B_4C$).

5. The particle of claim 1, wherein said fuel additive comprises a material selected from the group consisting of: silicon (Si), boron (B), and a combination thereof.

6. The particle of claim 4, wherein said metal boride is selected from the group consisting of: $AlB_{12}$, $AlB_2$, $MgB_2$ $Al_{0.5}Mg_{0.5}B_2$, $AlMgB_{14}CoB$, $CoB_2$, TiB and $TiB_2$, and any combination thereof.

7. The particle of claim 1, wherein said metal oxide is selected from the group consisting of: bismuth oxide, boron (III) oxide, chromium (III) oxide, manganese (IV) oxide, iron (III) oxide, copper (II) oxide, lead (II,IV) oxide, and any combination thereof.

* * * * *